US010360887B2

(12) United States Patent
Schlessinger

(10) Patent No.: US 10,360,887 B2
(45) Date of Patent: Jul. 23, 2019

(54) MUSICAL STRUM AND PERCUSSION CONTROLLER

(71) Applicant: Daniel Moses Schlessinger, Oakland, CA (US)

(72) Inventor: Daniel Moses Schlessinger, Oakland, CA (US)

(73) Assignee: Daniel Moses Schlessinger, Oakland, CA (US)

( * ) Notice: Subject to any disclaimer, the term of this patent is extended or adjusted under 35 U.S.C. 154(b) by 0 days.

(21) Appl. No.: 15/225,832

(22) Filed: Aug. 2, 2016

(65) Prior Publication Data

US 2017/0032775 A1 Feb. 2, 2017

Related U.S. Application Data

(60) Provisional application No. 62/200,101, filed on Aug. 2, 2015.

(51) Int. Cl.

| | |
|---|---|
| ***G10H 1/32*** | (2006.01) |
| ***G10H 1/00*** | (2006.01) |
| ***G10H 3/14*** | (2006.01) |
| ***G10H 1/055*** | (2006.01) |

(52) U.S. Cl.

CPC ..... *G10H 1/0066* (2013.01); *G10H 1/0551* (2013.01); *G10H 1/0556* (2013.01); *G10H 3/146* (2013.01); *G10H 2220/191* (2013.01); *G10H 2220/531* (2013.01)

(58) Field of Classification Search

CPC ..... G10H 1/342; G10H 1/348; G10H 3/146; G10H 1/0066; G10H 2220/191

USPC ..... 84/743

See application file for complete search history.

(56) References Cited

U.S. PATENT DOCUMENTS

| | | | | |
|---|---|---|---|---|
| 4,649,783 A | | 3/1987 | Karplus | |
| 5,300,730 A | * | 4/1994 | Ekhaus | G10D 3/163 84/320 |
| 5,354,947 A | * | 10/1994 | Kunimoto | G10H 1/16 84/622 |
| 5,396,025 A | * | 3/1995 | Tamura | G10H 1/12 84/736 |
| 5,498,836 A | * | 3/1996 | Okamoto | G10H 1/0066 84/626 |
| 5,500,486 A | * | 3/1996 | Smith, III | G10H 5/007 84/622 |

(Continued)

OTHER PUBLICATIONS

Johnson, "Charlie Lab Digitar", review of discontinued commercial product in Sound on Sound Magazine, Jan. 1995. Most relevant description is first 2 paragraphs. Accessed from https://web.archive.org/web/20150607013618/http://www.soundonsound.com/sos/1995_articles/jan95/charlielab.html on Dec. 11, 2017.

(Continued)

*Primary Examiner* — Jeffrey Donels

(57) ABSTRACT

A controller for musical instrument models is presented, comprising acoustic elements with embedded vibration sensors that the user actuates for example by plucking, strumming, or striking the elements. A vibration sensor attached to each acoustic element is used to generate an excitation signal for musical instrument models. A note input interface can be included so that note input such as MIDI can be used to control the musical pitch of the musical instrument models.

19 Claims, 7 Drawing Sheets

(56) References Cited

U.S. PATENT DOCUMENTS 5,578,781 A * 11/1996 Suzuki ..... G10H 1/16 84/661
5,739,454 A * 4/1998 Kunimoto ..... G10H 1/24 84/615
5,841,054 A * 11/1998 Komano ..... G10H 7/004 84/622
5,955,691 A * 9/1999 Suzuki ..... G10H 7/006 84/604
6,018,118 A * 1/2000 Smith ..... G10H 1/0066 84/600
6,049,034 A * 4/2000 Cook ..... G10H 5/007 84/659
6,066,794 A * 5/2000 Longo ..... G10H 1/02 84/600
RE37,422 E * 10/2001 Yamada ..... F16H 57/04 84/600
7,176,373 B1 * 2/2007 Longo ..... G10H 1/0066 84/600
7,381,881 B1 * 6/2008 Sapp ..... G10H 5/007 703/2
8,173,887 B2 5/2012 Sullivan
8,796,529 B2 8/2014 Butera
9,336,762 B2 * 5/2016 Hlatky ..... G10H 1/18
2008/0271594 A1 11/2008 Starr
2012/0137857 A1 * 6/2012 Liu ..... G10H 5/007 84/622
2015/0279343 A1 * 10/2015 Shi ..... G10H 1/0066 84/627

OTHER PUBLICATIONS

Starr Labs Ztar Z7S, product web page of commercial product believed to be an embodiment of 20080271594, accessed from https://www.starrlabs.com/product/z7s/ on Dec. 11, 2017.

Jamstik+ Portable Smart Guitar, product web page of commercial product believed to be an embodiment of U.S. Pat. No. 8,173,887, accessed from https://jamstik.com/products/jamstik on Dec. 11, 2017.

Artiphon Instrument 1 Manual, online instruction manual for a commercial product believed to be an embodiment of U.S. Pat. No. 8,796,529, accessed from https://artiphon.com/instrument-1-manual/ on Dec. 11, 2017. Especially relevant is the Strum Secton pp. 7-8.

* cited by examiner

MUSICAL STRUM AND PERCUSSION CONTROLLER

This application claims the priority benefit under 35 U.S.C. 119(e) of U.S. Provisional Application No. 62/200,101, filed Aug. 2, 2015.

FIELD OF THE INVENTION

The present invention relates to the field of digital musical instruments, and in particular the field of expressive control of virtual instruments.

BACKGROUND OF THE INVENTION

MIDI keyboard controllers are a flexible tool for keyboardists. They allow a keyboardist to use their existing knowledge of keyboard layout to play a multitude of different instrument sounds. However, not all instruments are sufficiently expressively controlled by a keyboard. A MIDI keyboard can come close to simulating the expressivity and feel of an acoustic piano, but it is difficult for a keyboardist using a MIDI keyboard to reproduce the nuances of a strummed guitar or percussion instrument.

There have been musical controllers that allow for virtual strumming and control of virtual percussion instruments, but none sufficiently capture the full nuance and rhythmic expressiveness of a real acoustic instruments while utilizing a keyboardists existing knowledge of the keyboard.

What is still very much needed is a musical controller that has the expressive potential to capture the nuances of a guitar or acoustic drum.

OBJECTS OF THE INVENTION

It is an object of this invention to create a more expressive controller for musicians.

Other objects and advantages of the invention will be apparent from the specification and drawings.

SUMMARY

In order to offer musicians a more nuanced way to interact with virtual instruments, one embodiment is a device comprised of acoustic elements with embedded vibration sensors that the user actuates for example by plucking, strumming, or striking the elements. A vibration sensor attached to each acoustic element is used to generate an excitation signal for musical instrument models.

Another embodiment is a method for actuating an acoustic element and a note input apparatus such that a signal from the acoustic element is sent to a musical instrument model as the excitation signal, and the note data from the note input apparatus is sent to the instrument model as pitch information.

Another embodiment is a device comprised of acoustic elements with embedded vibration sensors that the user actuates for example by plucking, strumming, or striking the elements. A vibration sensor attached to each acoustic element is used to generate an excitation signal for musical instrument models, and a note input device is included so that note input such as MIDI can be used to control the musical pitch of the musical instrument models.

BRIEF DESCRIPTION OF THE DRAWINGS

For a more complete understanding of the invention, reference is made to the following description and accompanying drawings, in which.

DETAILED DESCRIPTION OF EMBODIMENTS

Figure 1:
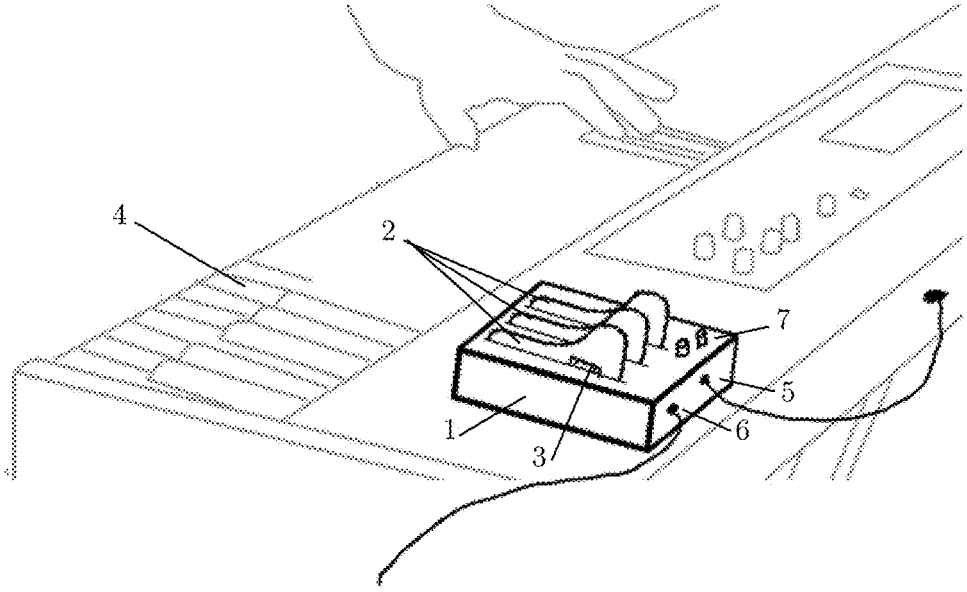
FIG. 1 shows an exemplary embodiment of the invention.

The arrangement in FIG. 1 shows an exemplary embodiment of the invention. The embodiment has a body [1] that holds one or more tines [2] that protrude outward from the body and are plucked by the user's hands. Each tine has a vibration sensor [ 3] made of piezoelectric film attached to it which converts the tine vibrations into a electric signals. The signals from the vibration sensors are digitized by an analog-to-digital converter and fed as an excitation signal into a digital physical model of a string instrument. In other embodiments, the digital physical model of a string can be replaced by any musical instrument model, analog or digital, for example an analog model of a marimba, a digital physical model of timpani, etc., and the acoustic signal from the vibration sensor is used by the musical instrument model as the excitation signal. The embodiment can also have a MIDI input port [5] that is configured to receive note data from a MIDI device [4]. In other embodiments the MIDI port can be replaced by some other note input device such as an Open Sound Control (OSC) port, USB MIDI port, onboard keyboard, capactive touch grid, touchscreen or tactile keyboard, or any other apparatus capable of receiving note or chord data. Other embodiments have a musical chord input device, and still others have no note interface at all. Notes played on the MIDI keyboard determine the musical pitch of the musical instrument model, as well as other parameters for example decay time, brightness, etc. In this embodiment, audio is outputted from a output jack [6]. Physical parameters of the digital physical string model can be adjusted by means of sensors [7] such as rotary dials, linear faders, force-sensitive sensors, capactitive touch sensors, foot pedals, or other means of tactile control.

Figure 2:
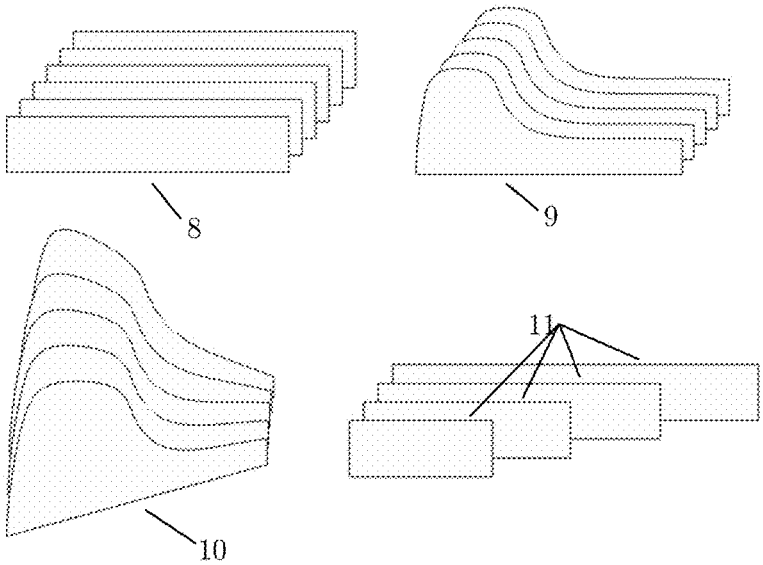
FIG. 2 shows different tine shapes and orientations.

The tines [2] in this embodiment are made of polycarbonate film. In other embodiments they can be made of plastic, wood, metal, or any stiff material with elastic properties. There are no strict restrictions on the number of tines, anywhere from 1 to 24 can be useful depending on the context. For example, one tine is useful for imitating rhythm guitar or solo guitar, whereas 24 strings are useful for recreating harp parts. The tines can range from 1/1000"-1/4" thick, with a recommended thickness of between 0.005"-0.03". The length can range from 1/4" to 20" long, and 0.1"-5" wide depending on the context. The spacing between the tines can range from between 1/16"-3" apart, with a recommended spacing of 3/8"-1" apart, so long as they remain individually pluckable by hand. They can also take on different shapes and orientations, as shown in FIG. 2. For example, the tines can be rectangular and straight and parallel [8], or they can be rounded [9] for acoustical reasons, they can be placed at an various angles [10] to each other, and they can be different lengths [11]. In some embodiments the tines can be replaced by lengths of strings or wires stretched across a playing surface like a guitar or harp.

In this embodiment the vibration sensors are made of piezoelectric film that are glued to the tines. In other embodiments the vibration sensor can be another sensor such as a magnetic coil pickup, acoustic microphone, optical microphone, force sensing resistor, bend sensor, or some other sensor capable of sensing the tines. In some embodiments they can be attached to the tines by an adhesive, or with a laminate covering the tine and vibration sensor together, or with a press fit, or in some other configuration allowing the vibration sensors to sense broadband vibrations in the tines. In the case of acoustic or optical microphones, the vibration sensors can be decoupled from the tine structure and attached elsewhere on the body, so long as they are able to sense broadband vibrations in the tines. The vibration sensor can output signal energy in a broadband frequency range from 20 hz to 20 khz. Other embodiments can have a low frequency cutoff of the sensor signal between 0 hz-400 Hz and a high frequency cutoff between 8 kHz-96 kHz, with a recommended frequency range of 20 hz to 20 kHz. The analog-to-digital converter in this embodiment samples the signal at sample rate of 44.1 kHz, other embodiments can have analog-to-digital converter settings performed at audio rates, between 4 khz to 192 khz samples per second, with a recommended sample rate being above 16 kHz.

Figure 11:
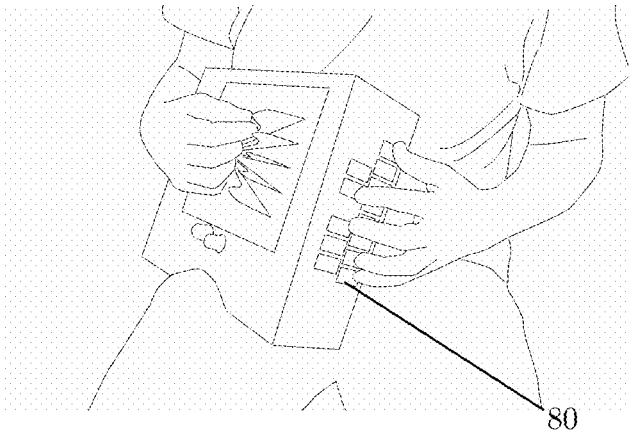
FIG. 11 shows an embodiment with an onboard keyboard.

There are no strict restrictions on body size, so long as they can securely support the tines, anywhere from having a 2" major dimension to an 8' major dimension, and the shape can vary by context. For example, some embodiments can be designed to fit on the user's lap, as shown in FIG. 11, or suspended by a strap like a guitar, or placed on the floor, or attached to a keyboard stand or microphone stand, and the size would vary in these cases.

Figure 3:
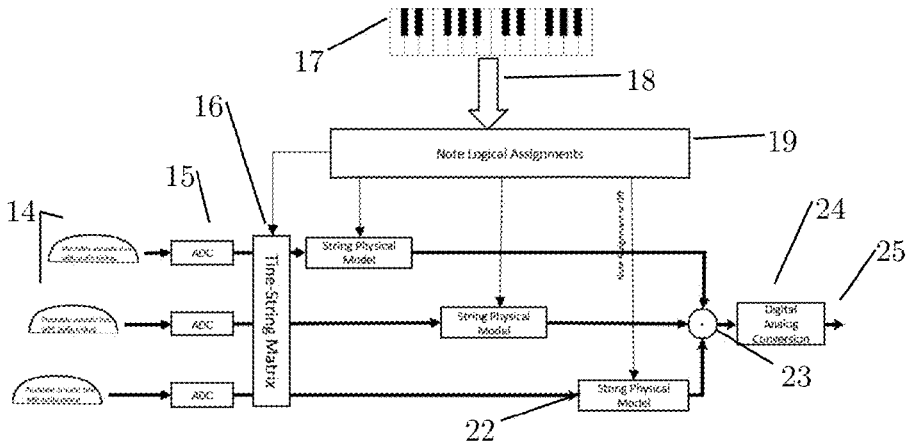
FIG. 3 shows a schematic for the signal topology of some embodiments.
Figure 4:
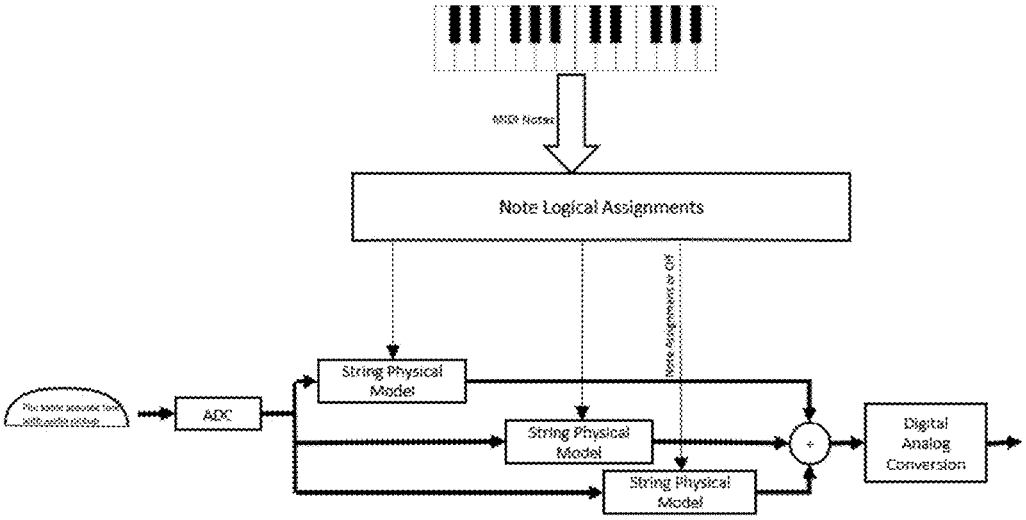
FIG. 4 shows a schematic for single-channel-in topology.

FIG. 3 shows the signal topology of the embodiment in FIG. 1. When the user plucks the tines, the signal generated by the vibration sensor [14] is routed into an analog to digital converter [15] and the digitized signal is fed into a separate digital physical model of string instruments [22] by means of a tine-signal routing matrix [16]. As specified before, the digital physical model of string instruments [22] can be replaced by other musical instrument models. MIDI note data [18] from a MIDI keyboard input [17] is sent into a note logical assignment block [19] which distributes the note pitch information as well as sustain and dampening information to the digital physical model of string instruments [22], for example in ascending musical pitch order. The tine-signal routing matrix [16] and note logical assignment block [19] work together to determine which tine signal is routed to which string model, based on the MIDI note data [18]. There are many different ways this can work depending on the playing context. For example, if there are two MIDI notes depressed on the MIDI keyboard input [17], the note logical assignment block [19] might fully dampen the physical characteristic of one digital physical string model, and then set the musical pitch data of the remaining physical string models so that the signals received from the vibration sensors are assigned to the digital physical models in ascending note order. Alternatively, the tine-signal routing matrix [16] can be simplified to a simple signal pass through for other playing contexts. The digital output of each model are summed together in a summer [23] block and outputted to a digital-to-analog converter [24]. The special case where the tine-signal routing matrix [16] is configured to route one signal to every digital physical model of string instruments [22] is called single-in topology. A simplified view of single-in topology is shown in FIG. 4. This topology can be useful in contexts where there is only one tine, or where it is desired for a single tine to sound with multiple notes as in a musical chord.

Figure 5:
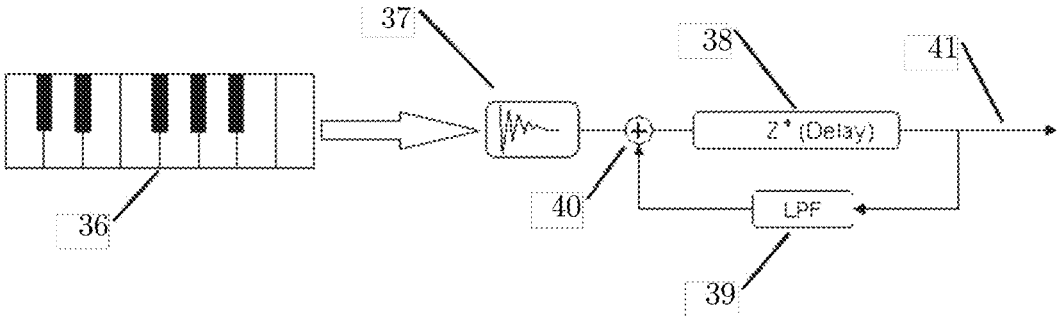
FIG. 5 shows a block diagram of a typical Karplus Strong string physical model implementation [PRIOR ART]
Figure 6:
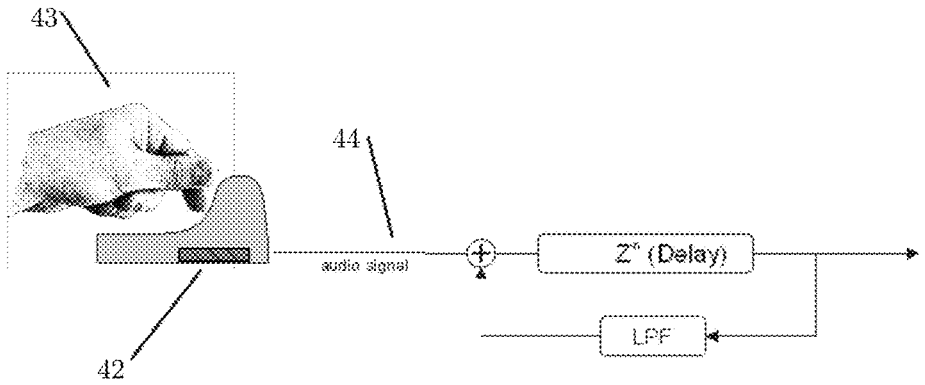
FIG. 6 shows a block diagram of the invention synthesis.

A schematic of an embodiment of a musical instrument model is shown in FIG. 6. A generalized schematic of the Karplus-Strong method of physical modeling of string instruments is shown in FIG. 5. In Karplus-Strong synthesis, shown in FIG. 5, there is an excitation signal [37], which is fed into a delay line [38] and fed back into the delay line through a low-pass filter block with gain [39], approximating the impulse response of a vibrating string. In Karplus-Strong synthesis, the excitation signal [37] is a finite-duration waveform that is preset or parameterized such as a filtered noise burst, a single impulse, or a short recording of a pluck attack. Playback of a Karplus-Strong model consists of triggering playback of the excitation signal, often in response to MIDI note input [36]. In the present embodiment (FIG. 6), the excitation signal [37] is replaced by a continuous audio signal [44] from the sensor [42] on the tine. In this embodiment, incoming MIDI note data does not trigger the onset of any sounds but instead simply assigns the musical pitch to the modified Karplus-Strong physical model of a string. In some embodiments other parameters of the musical instrument model can be controlled by the note data as well, for example, a MIDI note-on message can be used to open a gate and increase the decay time for the audio signal [44] to come through, and a MIDI note-off can be used to decrease the decay time of the musical instrument model without closing the gate allowing the audio signal [44] signals to continue through resulting in a dampened string sound.

Figure 7:
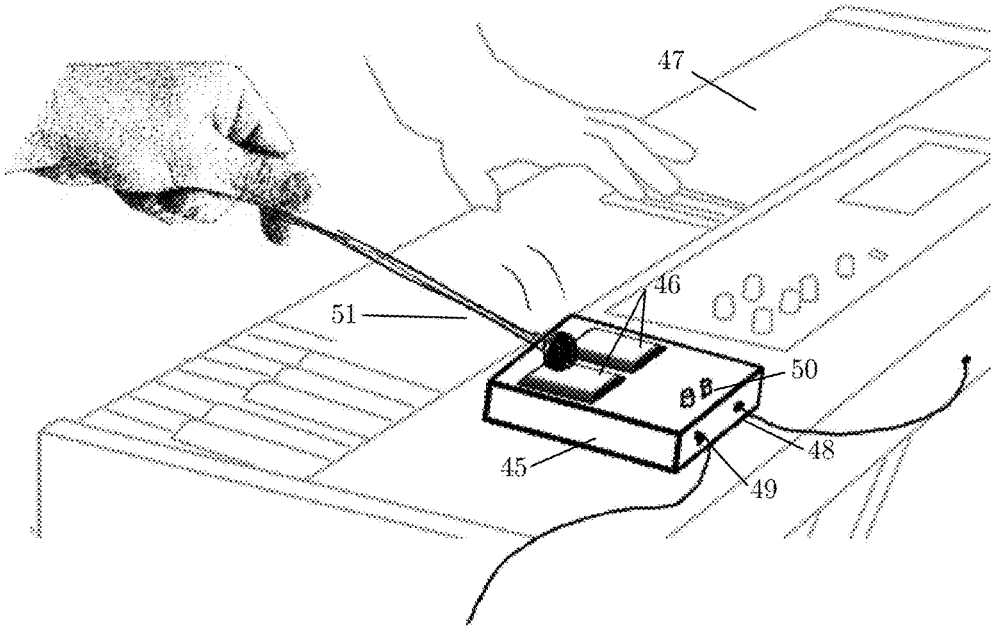
FIG. 7 shows an embodiment for percussion synthesis.

Another embodiment is the percussion embodiment, shown in FIG. 7, where the tines are replaced by percussion pads [46] which are struck by the user by means of a mallot [51], drumstick, or by hand or foot. The percussion pads [46] each have a sensor attached to them which convert the pad vibrations into a electric signals, and just as in FIG. 3 the signal from the vibration sensor is used as the excitation signal for a musical instrument model, and note information from a MIDI input port [48] is used in this embodiment to determine the pitch of the musical instrument model. The percussion pads [46] are made of ⅛" wood strips in this embodiment, but in other embodiments they can be made of any substance that produces a sound when struck, for example, wood, plastic, rubber, or metal. The percussion pads [46] can vary greatly in thickness, size, and shape for acoustic reasons, from 0.1" to 3" thick, 0.5" to 15" long and wide. The pads in this embodiment are mounted on the surface of the body [45], but in other embodiments the pads can be mounted in different ways, for example being suspended outward from the body to allow for striking on both sides, or protruding at different angles from the body. Varying the mounting type will result in the different acoustic properties and also can be changed according to the desired sound. The vibration sensor can be a peizoelectric element, magnetic coil pickup, acoustic microphone, optical microphone, force sensing resistor, or some other form of vibration sensor. The vibration sensors are glued to the bottom of the percussion pads [46], but in other embodiments the vibration sensors can be attached by example by a different adhesive, or attached by a clamp or screw, or it can be press fit into place by the body structure. Or, in the case of acoustic microphones, they can be decoupled from the tine structure and rely on airborne acoustic transmission, or in the case of optical microphones, attached elsewhere on the body.

Figure 8:
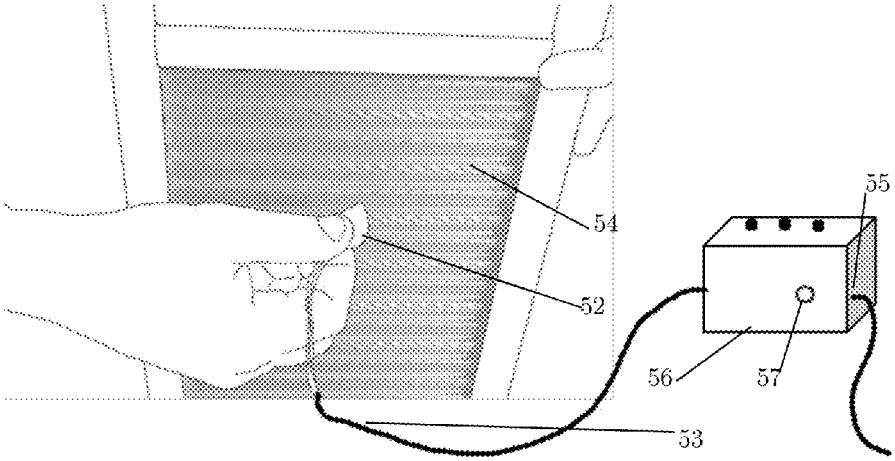
FIG. 8 shows an embodiment of the "magic pick"

Another embodiment is exemplified in figure FIG. 8, which we refer to as the "magic pick" embodiment. This embodiment has a plectrum [52] with a sensor attached that sends a signal either by a audio cable [53] or wirelessly to a processor [56]. The embodiment has a MIDI input [57] and an audio output [55]. In other embodiments, the MIDI input is a OSC input, usb, onboard keyboard, chord buttons, or some other note input device. This allows for strumming on any jagged surface with only a plectrum and a single analog-to-digital converter.

Figure 9:
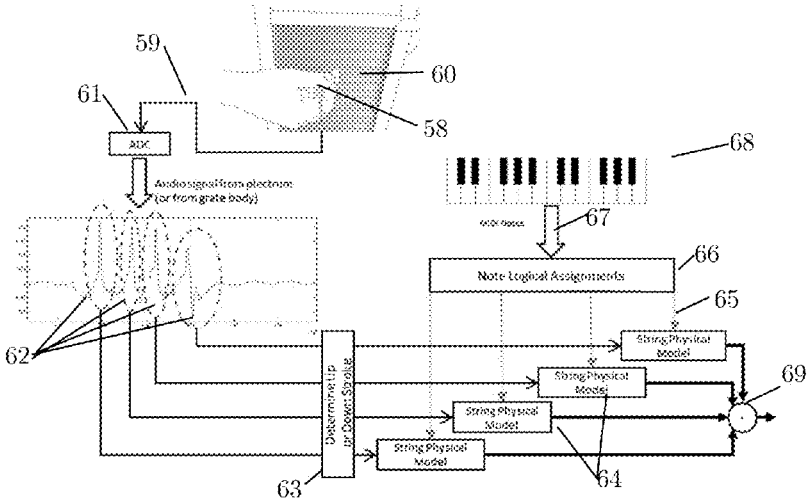
FIG. 9 shows the signal topology of a "magic pick" embodiment.

The topology of the "magic pick" is shown in FIG. 9. Signals generated from the vibration sensor on the plectrum [58] are digitized by an analog-to-digital converter [61] and fed into a signal pluck separator [62] that identifies individual plucks and separates the individual pluck signals into different channels and sends them into a stroke detection block [63] to determine whether the direction of the strum is up-stroke or down-stroke. The individual pluck signals are then sent as excitation signals to a musical instrument model [64], distributing according to whether the signal was generated by an up-stroke or a down stroke. As with FIG. 3, musical pitch information from the MIDI input [68] is used to control the pitches of the physical models. In another embodiment of the "magic pick," the signal from the vibration sensor is converted into MIDI output data as a strum controller for any MIDI synthesizer or software.

The "magic pick" is generally the size of a guitar plectrum but can vary, from ½" long to 4" long depending on the context. Like the tines in FIG. 1, they can be made of plastic, wood, or metal, or other appropriate material, and range from 0.01" thick to ¼" thick. Some embodiments of the "magic pick" include a handle made from wood or plastic, from ½" to 6" long, often with sensors on the handle for extra control. The sensor on the "magic pick" is made of piezoelectric film, though in other embodiments it can be a magnetic coil pickup, acoustic microphone, optical microphone, force sensing resistor, bend sensor, or other sensor capable of sensing the plectrum.

An embodiment related to the "magic pick" is the "magic washboard," which uses the same topology as the "magic pick" (FIG. 9), but instead the sensor is attached to the washboard or other corrugated surface instead of on the plectrum itself.

Figure 10:
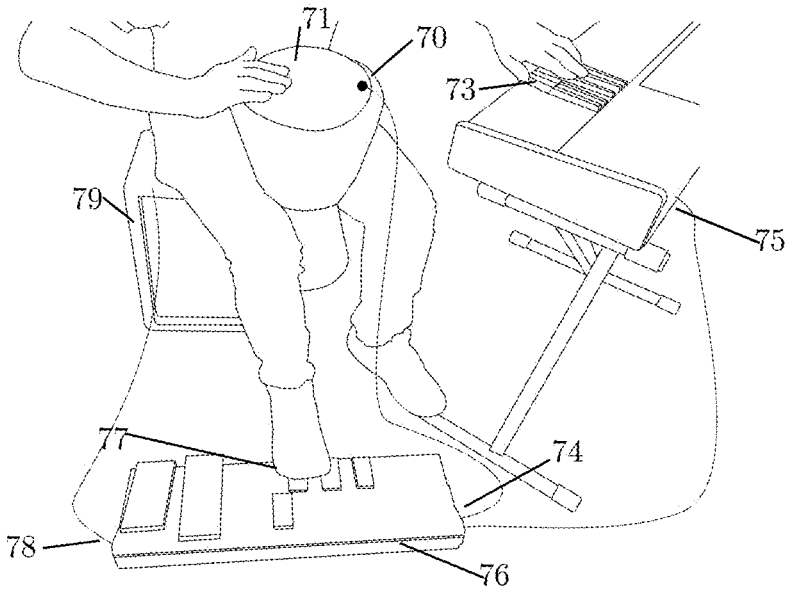
FIG. 10 shows an embodiment with an audio input and with a form factor of a floor pedal.

All embodiments can use audio input jacks to receive excitation data for the musical instrument models. An example of this is shown in FIG. 10. In this embodiment, only one input jack is used, though more inputs are possible, and the body [76] of the embodiment is in the form of a floor pedal. In this embodiment a contact pickup [70] attached to the drum, and vibrations generated from the drum or percussion instrument [71] are picked up by the contact pickup [70] and plugged into the audio input jack [74], where the inputs are digitized and fed into a physical instrument model as in FIG. 4, replacing the tines and vibration sensors with the audio from the input jack. Onboard foot control pedals [77] can be used to determine the pitch, damping, and parameters of the musical instrument model. There can also be a MIDI input [75] to receive note data from a MIDI keyboard. The output [78] of the instrument is then fed into an amplifier [79].

Figure 12:
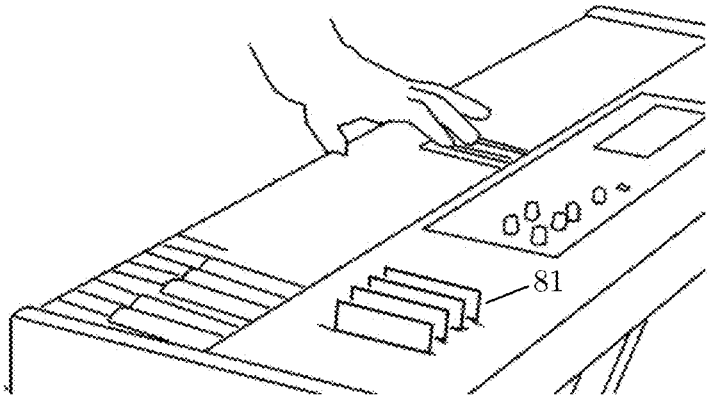
FIG. 12 shows an embodiment with the form factor of a traditional keyboard.

All embodiments can have an onboard musical keyboard as the note input device. For example, FIG. 11 and FIG. 12 show example embodiments with onboard musical keyboards. FIG. 12 shows an embodiment taking the form factor of a traditional musical keyboard with tines [81] protruding from the keyboard body. FIG. 11 shows an alternate form factor where the body sits on the user's lap and has a keyboard [80] attached in a way that resembles an the form factor of an accordion. Other embodiments can have keyboards that function in alternate ways, for example by capacitive touch, or by touchscreen. Alternate note layouts, for example isomorphic keyboard layouts, are also possible.

Figure 13:
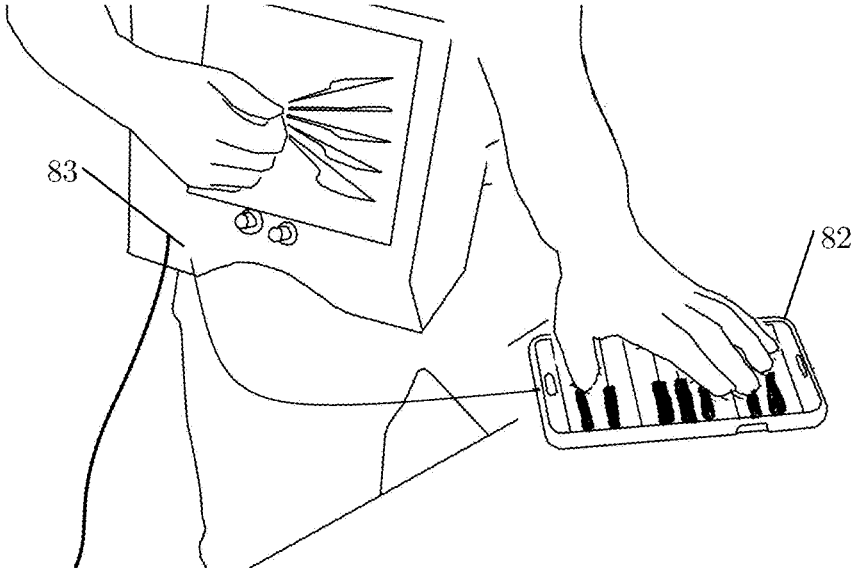
FIG. 13 shows the system utilizing a mobile device.

All embodiments can do the digital processing and user input using a mobile device, as shown in FIG. 13. In these embodiment, the audio signals from the instrument body [83] are fed into the mobile device [82], either as digital or analog signals. The keyboard entry takes place on the mobile device screen, and the digital processing takes place as an app or software on the mobile device. The audio is then outputted from the mobile device, or from an audio interface. In a related embodiment, the embodiment also functions as an audio interface for the mobile device.

Figure 14:
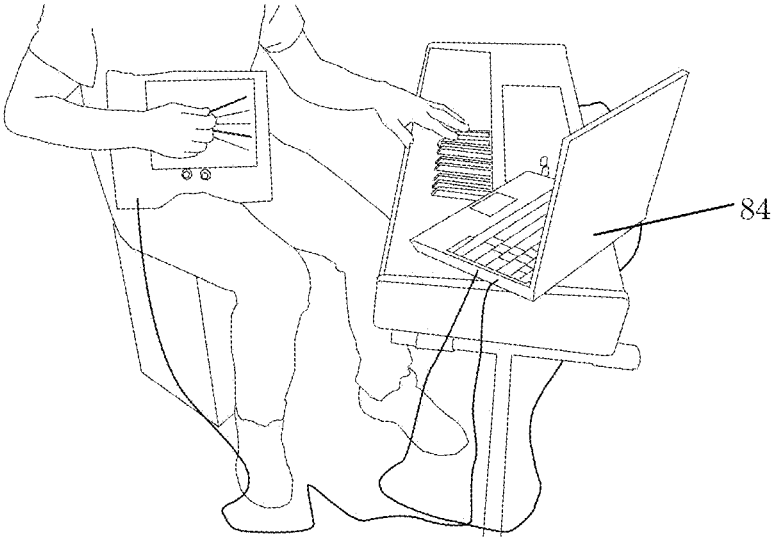
FIG. 14 shows the instrument as an audio plugin for a digital audio workstation.

All embodiments can do the digital processing and MIDI input using a software plugin for a digital audio workstation (DAW) such as a VST, as in FIG. 14. In this embodiment, the audio signals from the tines are fed into a computer, either through an audio interface or where the embodiment itself functions as an audio interface. The raw pluck signals are saved to a track in the DAW, and an accompanying VST plugin converts the plucked sounds into musical instrument models.

All embodiments can also include an acoustic speaker or transducer on the body.

All embodiments can also include one or more external foot pedals for additional control.

All embodiments can also include effects processors in the signal chain, such as reverb, delays, loopers, distortion, or other musical audio effects to enhance the output audio. Advanced effects include an audio looper to loop the raw pluck signals from anywhere to 0.5 seconds to 5 minutes in length, with recommended lengths of 1 to 5 seconds, to allow looped rhythmic playback while the user plays different notes or chords on the MIDI keyboard.

All embodiments can be played by more than one player or modified to do so, with one person actuating the acoustic elements while another person plays the keyboard input.

It will thus be seen that the objects set forth above, among those made apparent from the preceding description, are efficiently attained and, because certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

The invention has been described with respect to various embodiments having various features. A person of ordinary skill in the art will appreciate that the scope of the invention described herein also includes embodiments incorporating one or more of these features in combinations other than those expressly described herein.

The various devices, methods, procedures, and techniques described above provide a number of ways to carry out the invention. Of course, it is to be understood that not necessarily all objectives or advantages described may be achieved in accordance with any particular embodiment described herein. Also, although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, the invention is not intended to be limited by the specific disclosures of preferred embodiments herein.

What is claimed:

1. A method of generating a musical sound comprising:

Actuating an acoustic element;

Actuating a note input apparatus;

Sending a signal from the acoustic element to a sensor;

Sending a continuous audio signal from the sensor to a musical instrument model as an excitation signal; and Sending note data from the note input apparatus to the instrument model as pitch information;

wherein the acoustic element is strummed over a corrugated surface; and individual pluck signals from the sensor are separated and sent into separate musical instrument models.

2. The method of claim 1 wherein individual pluck signals from the sensor are separated and converted into note output data.

3. The method of claim 1 wherein the strum direction is detected from the signal from the sensor and used to change parameters of the musical instrument models.

4. The method of claim 2 wherein the strum direction is detected from the signal from the sensor and converted into note output data.

5. A musical device comprising:

An acoustic element;

a sensor;

a musical instrument model;

a note input device capable of accepting note on and off data;

the acoustic element in communication with the sensor;

the sensor configured to output a continuous audio signals; wherein the excitation signal for the musical instrument model is a continuous audio signal received from the sensor;

the musical instrument model uses note on and off data from the note input device to determine pitch and decay time of the model; and the musical instrument model can continue to be excited by the continuous audio signal from the sensor and produce audio output even after receiving a note off message from the note input device.

6. The device of claim 5 wherein the acoustic element is a pluckable tine or pluckable string.

7. The device of claim 5 wherein the musical instrument model is a physical model of a string instrument or percussion instrument.

8. The device of claim 5 further comprising multiple acoustic elements wherein each acoustic element is in communication with a sensor and wherein the elements are arranged in close enough proximity to each other that they can be strummed by the user.

9. The device of claim 8 further comprising a routing matrix wherein the inputs to the matrix are signal from the sensors and the outputs of the matrix are routed the to musical instrument models.

10. The device of claim 9 wherein data from the note input device is used to determine the signal routing of the routing matrix.

11. The device of claim 10 wherein the routing matrix routes signals from sensors to the musical instrument models in sequential order, where the order of the sensors is the sequential arrangement of their associated acoustic element and the order of the musical instrument models is the sequential order of the pitch currently assigned to each musical instrument model.

12. The device of claim 5 further comprising a pluck signal separator wherein the pluck signal separator receives the signal from a sensor and outputs individual pluck signals each of which are routed to a musical instrument model.

13. The device of claim 5 further comprising a strum direction detection apparatus, wherein the strum direction detection apparatus ascertains strum or pluck direction from a sensor and the strum or pluck direction to alter parameters of the musical instrument model.

14. The device of claim 5 further comprising an audio looping apparatus wherein the audio looping apparatus outputs a looped continuous audio signal and wherein the excitation signal for the musical instrument model the looped continuous audio signal received from the audio looping apparatus.

15. The device of claim 14 wherein the audio looping apparatus receives a continuous audio signal from the sensor.

16. The device of claim 15 wherein the audio looping apparatus is capable of recording a segment of audio received from the sensor.

17. A musical device comprising:

an audio looping apparatus;

an audio signal;

a note input device capable of accepting note on and off data;

a musical instrument model; wherein the audio looping apparatus outputs the audio signal in a loop;

the excitation signal for the musical instrument model the looped signal received from the audio looping apparatuses; and the musical instrument model uses note data from the note input apparatus to alter pitch and dampening parameters of the musical instrument model.

18. The device of claim 12 further comprising a sensor in communication with a pluckable tine, strikeable object or pluckable string wherein the audio looping apparatus receives a continuous audio signals from the sensor.

19. The device of claim 10 wherein the musical instrument model is a physical model of a string instrument or percussion instrument.

* * * * *